US012628968B1

(12) United States Patent
Zhang

(10) Patent No.: US 12,628,968 B1
(45) Date of Patent: May 19, 2026

(54) MULTI-FUNCTIONAL FENCE FOR INFANTS

(71) Applicant: Wentao Zhang, Beijing (CN)

(72) Inventor: Wentao Zhang, Beijing (CN)

( * ) Notice: Subject to any disclaimer, the term of this patent is extended or adjusted under 35 U.S.C. 154(b) by 0 days.

(21) Appl. No.: 19/433,524

(22) Filed: Dec. 26, 2025

(51) Int. Cl.
*A47D 13/06* (2006.01)
*E04H 17/00* (2006.01)
*E04H 17/18* (2006.01)

(52) U.S. Cl.
CPC ..... *A47D 13/066* (2013.01); *E04H 17/013* (2021.01); *E04H 17/185* (2021.01)

(58) Field of Classification Search
CPC ..... E04H 17/013; E04H 17/18; E04H 17/185; A47D 13/065; A47D 13/066
See application file for complete search history.

(56) References Cited

U.S. PATENT DOCUMENTS 4,929,113 A * 5/1990 Sheu ..... F16C 11/045 403/324
9,615,672 B2 * 4/2017 Weisbeck ..... A47D 13/06
11,523,692 B2 * 12/2022 Yager Grad ..... A47D 13/066
11,553,804 B2 * 1/2023 Matsumoto ..... F16B 7/18
2007/0210293 A1 * 9/2007 Cheng ..... E04H 17/18 256/26
2023/0337626 A1 * 10/2023 Chen ..... E04H 17/185

FOREIGN PATENT DOCUMENTS

FR 1 021 234 * 2/1953

* cited by examiner

*Primary Examiner* — Michael P Ferguson

(57) ABSTRACT

The present application discloses a multi-functional fence for infants, comprising: a plurality of fences, a plurality of fence connectors, a plurality of wall connectors, and a gate mechanism. Adjacent fences are connected to each other via the fence connectors. The gate mechanism is arranged between two of the fences, with both ends of the gate mechanism respectively connected to the corresponding fences via fence connectors. The fences located at both ends are provided with wall connectors at their end portions, which are used for connection and fixation to a wall, thereby securing the entire fence.

9 Claims, 21 Drawing Sheets

MULTI-FUNCTIONAL FENCE FOR INFANTS

FIELD OF THE APPLICATION

The present invention relates to the technical field of infant and toddler products, specifically to a multi-functional fence for infants.

BACKGROUND

Currently, most infant fences on the market are assembled by connecting multiple fence units through connectors, forming an independent safe area for infants and toddlers to play inside. However, infant fences in the prior art typically suffer from the following shortcomings:

Limited installation and fixation methods, with stability needing improvement: Most fences can only stand on the ground relying on their own structure, resulting in generally moderate overall stability. They are prone to being pushed over or toppling when infants climb on them, posing safety hazards. Although some fences are designed with anti-slip pads, it is still difficult to completely prevent displacement.

Inconvenient shape adjustment and poor adaptability: Traditional fence connectors usually only allow fixed-angle connections (e.g., 90°, 180°), or have limited adjustment ranges and complex operations. This makes it difficult to flexibly adjust the shape of the fence (e.g., linear, L-shaped, U-shaped, or enclosed polygon) according to room layout, furniture placement, or usage needs, limiting its applicable scenarios.

To overcome the above-mentioned deficiencies, there is a need for a multi-functional fence for infants.

SUMMARY

The technical problem to be solved by the present invention is to overcome the aforementioned technical deficiencies of the prior art and to provide a multi-functional fence for infants.

To solve the above technical problem, the technical solution provided by the present invention is a multi-functional fence for infants, comprising a plurality of fences, a plurality of fence connectors, a plurality of wall connectors, and a gate mechanism; wherein adjacent ones of the plurality of fences are connected to each other via the fence connectors; the gate mechanism is arranged between two of the fences, and both ends of the gate mechanism are respectively connected to the corresponding fences via fence connectors; the fences located at both ends are provided with wall connectors at their end portions for connection and fixation to a wall, thereby securing the entire fence;

The wall connectors comprise an upper wall connector and a lower wall connector, the upper wall connector being installed at an upper end portion of a fence, and the lower wall connector being installed at a lower end portion of a fence;

The upper wall connector comprises a first wall connector head, a first fence connecting sleeve, a first pin shaft, a first spring and a first button; one end of the first fence connecting sleeve is connected to a fence, and another end of the first fence connecting sleeve is provided with a first adapter; an upper end of the first wall connector head is provided with a first button blind hole, a bottom of the first button blind hole is provided with a first circular rotation chamber, and a top of the first circular rotation chamber is provided with a circle of first tooth grooves arranged in a circumferential array; the first button is arranged within the first button blind hole, and a lower end of the first button is provided with a circle of first limiting teeth arranged in a circumferential array, the first limiting teeth meshing with the first tooth grooves; a center portion of the bottom of the first button blind hole is provided with a first hole extending downward into the first adapter, a bottom of the first hole is provided with a first shaft hole, the first pin shaft is arranged within the first shaft hole and its upper end passes through the first hole to connect to a lower side of the first button; an inner wall of the first hole is provided with a circle of second tooth grooves arranged in a circumferential array, a lower end of the first pin shaft is provided with a circle of second limiting teeth arranged in a circumferential array, the second limiting teeth meshing with the second tooth grooves; the first spring is sleeved outside the first pin shaft within the first hole, an upper end of the first spring abuts against the lower side of the first button; when the first button is pressed, the first button and the first pin shaft simultaneously move downward, compressing the first spring; when the first limiting teeth on the first button all move into the first circular rotation chamber, the second limiting teeth also completely disengage from the second tooth grooves, thereby releasing the limitation between the first wall connector head and the first adapter so that the first wall connector head and the first adapter can rotate relative to each other, allowing adjustment of the placement direction of the fence; releasing the press on the first button, under the action of the first spring, the first limiting teeth reset and mesh with the first tooth grooves, and the second limiting teeth reset and mesh with the second tooth grooves, thereby completing locking between the first wall connector head and the first adapter;

One end portion of the first wall connector head is provided with a first perforated connecting plate, the first perforated connecting plate being connected to a wall via a bolt.

As an improvement, a lower end of the first adapter is provided with a first chamber coaxial with the first shaft hole, for providing travel space for downward movement of the first pin shaft.

As an improvement, the lower wall connector comprises a second wall connector head, a second fence connecting sleeve, and a second adapter. The second wall connector head and the second adapter are rotatably connected via a bolt. One end of the second wall connector head is provided with a second perforated connecting plate, and the second perforated connecting plate is connected to a wall via a bolt. One end of the second adapter is connected to the second fence connecting sleeve, and the second fence connecting sleeve is connected to a fence.

As an improvement, the fence connector comprises an upper fence connector, a lower fence connector, and a connecting rod. Upper and lower ends of the connecting rod are respectively and rotatably provided with the upper fence connector and the lower fence connector. The upper fence connector is connected at both ends to upper end portions of two adjacent fences respectively, and the lower fence connector is connected at both ends to lower end portions of the two adjacent fences respectively.

As an improvement, the upper fence connector comprises a first upper fence connector head, a second upper fence connector head, an upper fence connecting sleeve, a second pin shaft, a second spring, and a second button. Each of the first upper fence connector head and the second upper fence connector head is provided with an upper fence connecting sleeve, and one end of the upper fence connecting sleeve is connected to a fence. An upper end of the first upper fence connector head is provided with a second button blind hole, a bottom of the second button blind hole is provided with a second circular rotation chamber, and a top of the second circular rotation chamber is provided with a circle of third tooth grooves arranged in a circumferential array. The second button is arranged within the second button blind hole, and a lower end of the second button is provided with a circle of third limiting teeth arranged in a circumferential array, the third limiting teeth meshing with the third tooth grooves. A center portion of the bottom of the second button blind hole is provided with a second hole extending downward into the second upper fence connector head, a bottom of the second hole is provided with a second shaft hole, and a lower end of the second upper fence connector head is provided with a lower hole coaxial with the second shaft hole. The second pin shaft is arranged within the second shaft hole, and its upper end passes through the second hole to connect to a lower side of the second button. An inner wall of the second hole is provided with a circle of fourth tooth grooves arranged in a circumferential array, and a lower end of the second pin shaft is provided with a circle of fourth limiting teeth arranged in a circumferential array, the fourth limiting teeth meshing with the fourth tooth grooves. The second spring is sleeved outside the second pin shaft within the second hole, and an upper end of the second spring abuts against the lower side of the second button. When the second button is pressed, the second button and the second pin shaft simultaneously move downward, compressing the second spring. When the third limiting teeth on the second button all move into the second circular rotation chamber, the fourth limiting teeth also completely disengage from the fourth tooth grooves, thereby releasing the limitation between the first upper fence connector head and the second upper fence connector head, so that the first upper fence connector head and the second upper fence connector head can rotate relative to each other, allowing adjustment of the included angle between the fences. Releasing the press on the second button, under the action of the second spring, the third limiting teeth reset and mesh with the third tooth grooves, and the fourth limiting teeth reset and mesh with the fourth tooth grooves, thereby completing the locking between the first upper fence connector head and the second upper fence connector head. An upper end of the connecting rod is placed within the lower hole.

As an improvement, the lower fence connector comprises two lower fence connector heads and a lower fence connecting sleeve; an end portion of each lower fence connector head is provided with a lower fence connecting sleeve, one end of the lower fence connecting sleeve is connected to a fence; the two lower fence connector heads are rotatably connected via a bolt;

An upper end of the upper one of the lower fence connector heads is provided with an upper hole, and a lower end of the connecting rod is placed within the upper hole.

As an improvement, upper and lower ends of the fence, and upper and lower ends of the gate mechanism are each provided with a mounting hole, and the mounting hole is provided with a press-return device;

Each of the second fence connecting sleeve, the first fence connecting sleeve, the upper fence connecting sleeve, and the lower fence connecting sleeve is provided with an insertion hole, and the insertion hole cooperates with the corresponding press-return device.

As an improvement, the gate mechanism comprises a door frame and a door bar; both upper ends of the door frame are respectively connected to the corresponding upper fence connecting sleeves, and both lower ends of the door frame are respectively connected to the corresponding lower fence connecting sleeves; the door frame is provided with the door bar therein; one side of an upper end of the door bar and an inner side of an upper end of the door frame are each provided with a rotating joint, and the two rotating joints are rotatably connected via a pin; a side of the door bar provided with the rotating joint has a rotating shaft hole below the rotating joint, a side of the door frame provided with the rotating joint has a shaft rod below the rotating joint, and a lower portion of the door bar is rotatably mounted on the shaft rod via the rotating shaft hole;

an upper end of the door bar is provided with a dual safety gate lock, and the dual safety gate lock cooperates with the door frame to achieve opening and closing of the door bar.

As an improvement, the fence is provided with a plurality of toys.

The advantages of the present invention compared to the prior art are as follows:

1. A plurality of fences are connected via fence connectors, and a gate mechanism is installed via fence connectors between two of the fences, forming an overall U-shaped fence with an opening at one end. Then, wall connectors are installed on the fences at both ends of the fence, so that the fence can be connected and fixed to a wall via the wall connectors, thereby securing the entire fence. This makes the fence more stable during use, and the fence can also be disassembled when not in use. Furthermore, entry and exit from the fence are achieved through the gate mechanism;

Alternatively, a plurality of fences are connected via fence connectors, and a gate mechanism is installed via fence connectors between two of the fences, forming an overall enclosed fence on all sides. Then, entry and exit from the fence are achieved through the gate mechanism. This allows the fence to be placed and used in any location, making it more convenient to use.

2. Fence connectors and wall connectors are provided. Both the fence connectors and the wall connectors can achieve 270-degree rotation, thereby allowing adjustment of the angle between fences via the fence connectors and adjustment of the angle between a fence and a wall via the wall connectors. Consequently, the shape of the arranged fence can be adjusted according to site conditions and usage requirements, making the fence more convenient to use.
3. Upper and lower ends of the fence, and upper and lower ends of the gate mechanism are each provided with a mounting hole containing a press-return device. The second fence connecting sleeve, the first fence connecting sleeve, the upper fence connecting sleeve, and the lower fence connecting sleeve are each provided with an insertion hole that cooperates with the corresponding press-return device. Thus, when assembling the fence, the press-return device can be pressed by hand, causing it to retract and fix within the mounting hole. Then, the fence connectors and wall connectors are inserted onto the upper and lower ends of the fence and the upper and lower ends of the gate mechanism, aligning the insertion holes with the mounting holes. Subsequently, a rod-shaped item such as a thin round rod is inserted into the insertion hole to press the press-return device, causing it to extend, with its upper end entering the insertion hole. This achieves limited positioning and fixation of the fence connectors and wall connectors, enabling quick completion of installation and disassembly, and providing greater convenience in use.

4. The fence is provided with a plurality of toys. Thus, when an infant is placed inside the fence to play, they can play with the toys, which can bring more fun to the infant.

BRIEF DESCRIPTION OF THE DRAWINGS

As shown in FIGS. 1-21:

1. Fence, 2. Upper Wall Connector, 3. Lower Wall Connector, 4. First Wall Connector Head, 5. First Fence Connecting Sleeve, 6. First Pin Shaft, 7. First Spring, 8. First Button, 9. First Adapter, 10. First Button Blind Hole, 11. First Circular Rotation Chamber, 12. First Tooth Groove, 13. First Limiting Tooth, 14. First Hole, 15. First Shaft Hole, 16. Second Tooth Groove, 17. Second Limiting Tooth, 18. First Perforated Connecting Plate, 19. First Chamber, 20. Second Wall Connector Head, 21. Second Fence Connecting Sleeve, 22. Second Adapter, 23. Second Perforated Connecting Plate, 24. Upper Fence Connector, 25. Lower Fence Connector, 26. Connecting Rod, 27. First Upper Fence Connector Head, 28. Second Upper Fence Connector Head, 29. Upper Fence Connecting Sleeve, 30. Second Pin Shaft, 31. Second Spring, 32. Second Button, 33. Second Button Blind Hole, 34. Second Circular Rotation Chamber, 35. Third Tooth Groove, 36. Second Hole, 37. Second Shaft Hole, 38. Lower Hole, 39. Third Limiting Tooth, 40. Lower Fence Connector Head, 41. Lower Fence Connecting Sleeve, 42. Upper Hole, 43. Mounting Hole, 44. Press-Return Device, 45. Door Frame, 46. Door Bar, 47. Rotating Joint, 48. Rotating Shaft Hole, 49. Shaft Rod, 50. Dual Safety Gate Lock, 51. Toy, 52. Fourth Tooth Groove, 53. Fourth Limiting Tooth, 54. Insertion Hole.

While the technology is susceptible to various modifications and alternative forms, specifics thereof have been shown by way of example and drawings, and will be described in detail. It should be understood, however, that the application is not limited to the particular embodiments described. On the contrary, the application is to cover modifications, equivalents, and alternatives falling within the spirit and scope of the technology.

DETAILED DESCRIPTION OF EMBODIMENTS

The embodiments of the present technology described herein are not intended to be exhaustive or to limit the technology to the precise forms disclosed in the following detailed description. Rather, the embodiments are chosen and described so that others skilled in the art can appreciate and understand the principles and practices of the present technology.

All publications and patents mentioned herein are hereby incorporated by reference. The publications and patents disclosed herein are provided solely for their disclosure. Nothing herein is to be construed as an admission that the inventors are not entitled to antedate any publication and/or patent, including any publication and/or patent cited herein.

The following provides a further detailed description of the multi-functional fence for infants according to the present invention in conjunction with the accompanying drawings.

With reference to FIGS. 1-21, a multi-functional fence for infants comprises a plurality of fences 1, a plurality of fence connectors, a plurality of wall connectors, and a gate mechanism.

Figure 1:
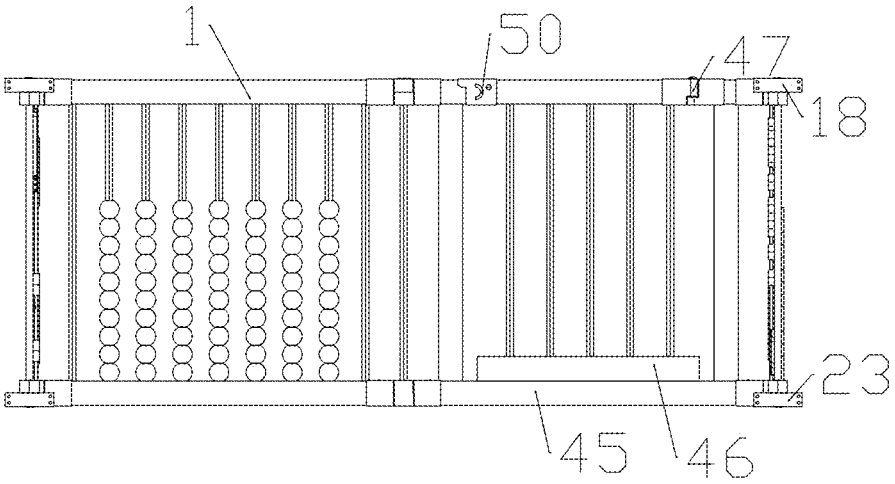
FIG. 1 is a rear view of the multi-functional fence for infants according to the present invention.
Figure 2:
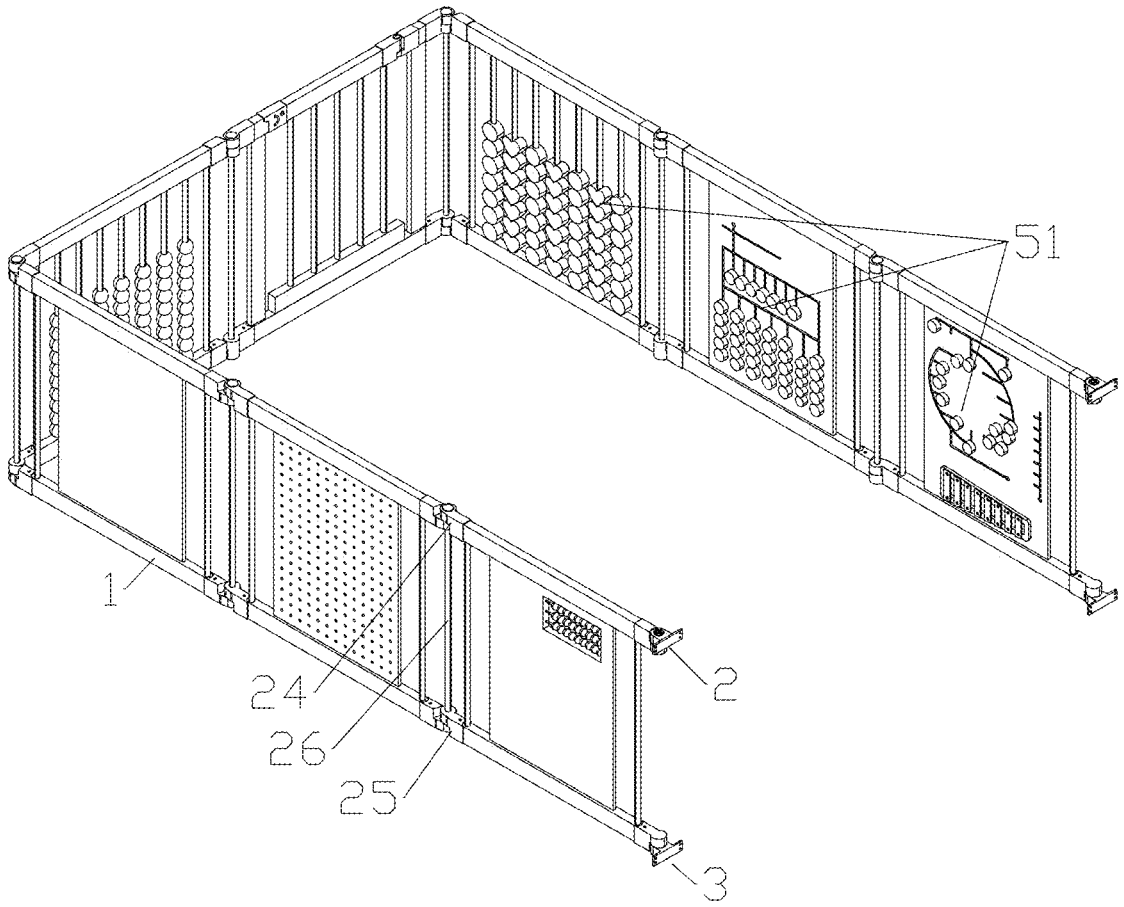
FIG. 2 is a schematic perspective structural view from the right side of the multi-functional fence for infants according to the present invention.
Figure 3:
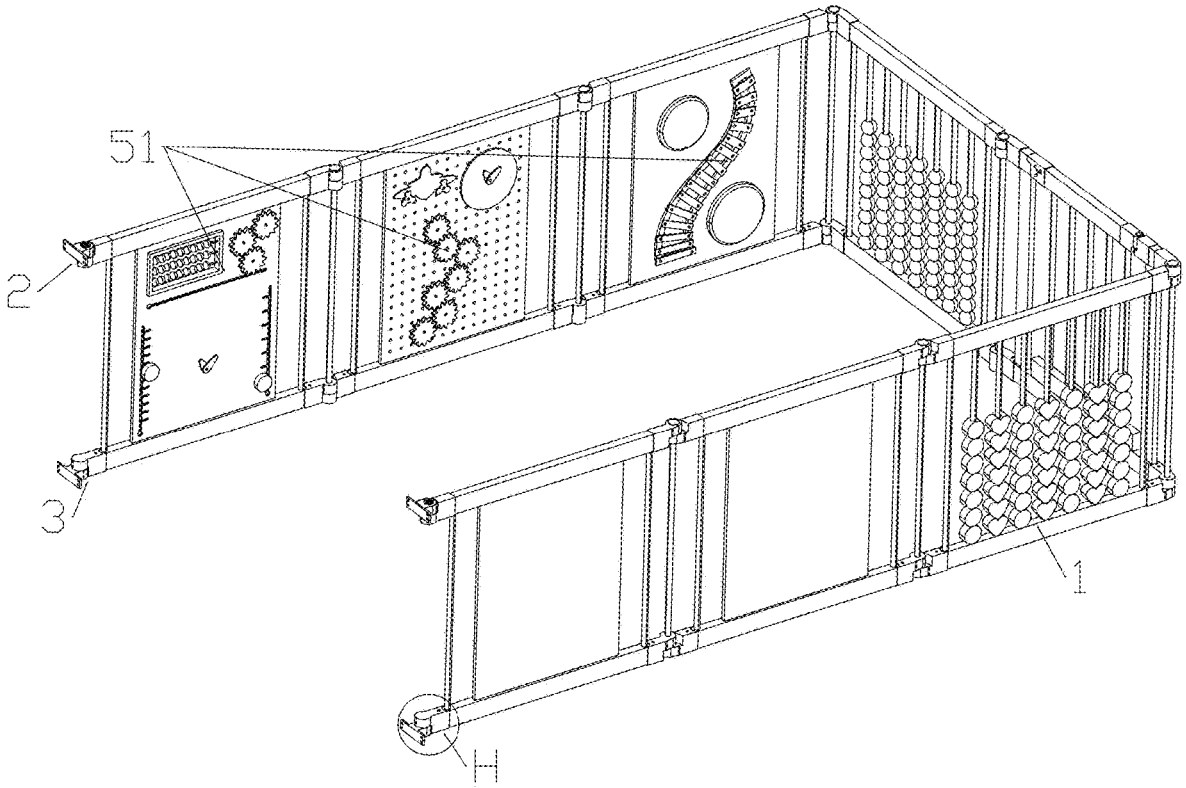
FIG. 3 is a schematic perspective structural view from the left side of the multi-functional fence for infants according to the present invention.
Figure 4:
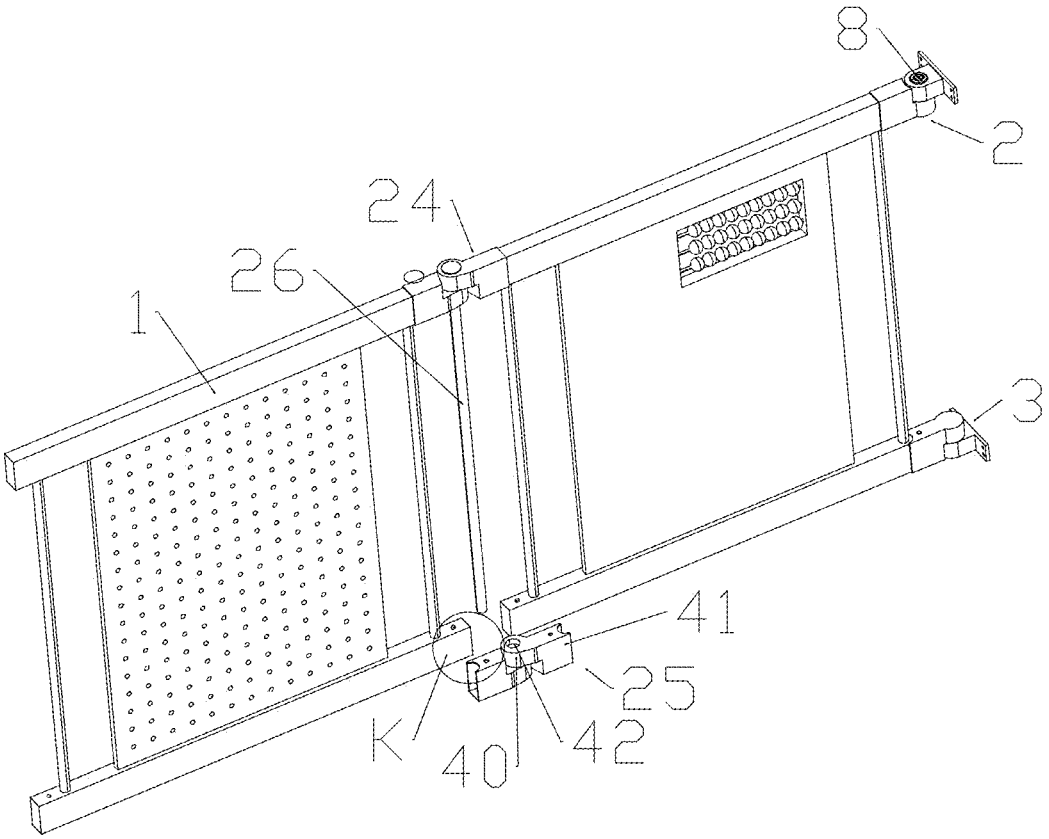
FIG. 4 is a schematic structural view of the fence and the lower wall connector of the multi-functional fence for infants according to the present invention in a disassembled state.
Figure 5:
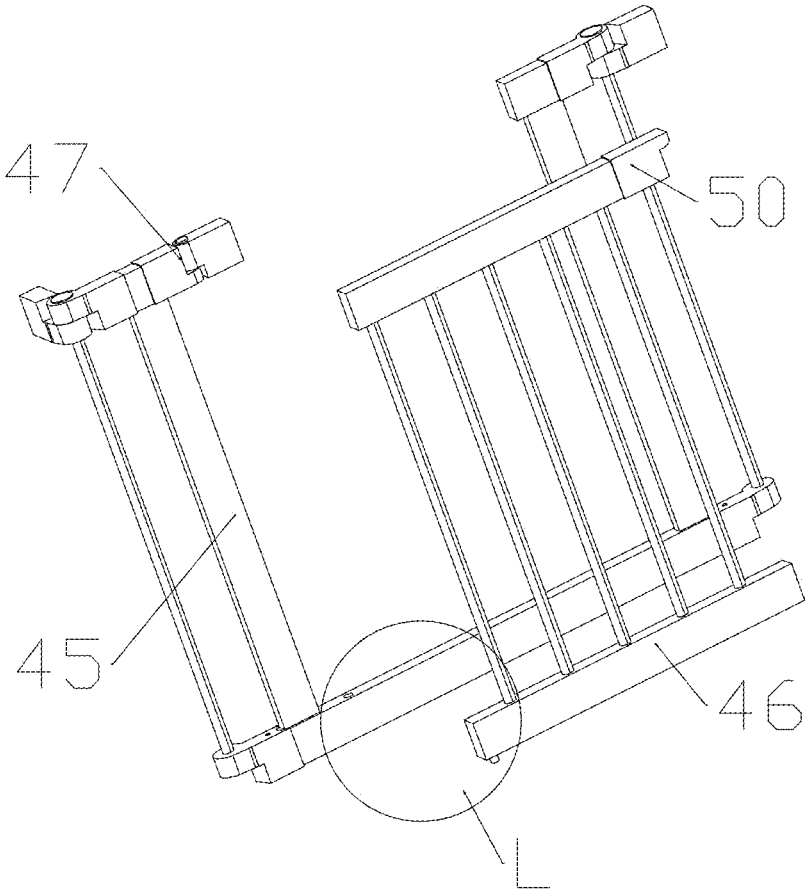
FIG. 5 is a schematic structural view of the gate mechanism of the multi-functional fence for infants according to the present invention in a disassembled state.
Figure 6:
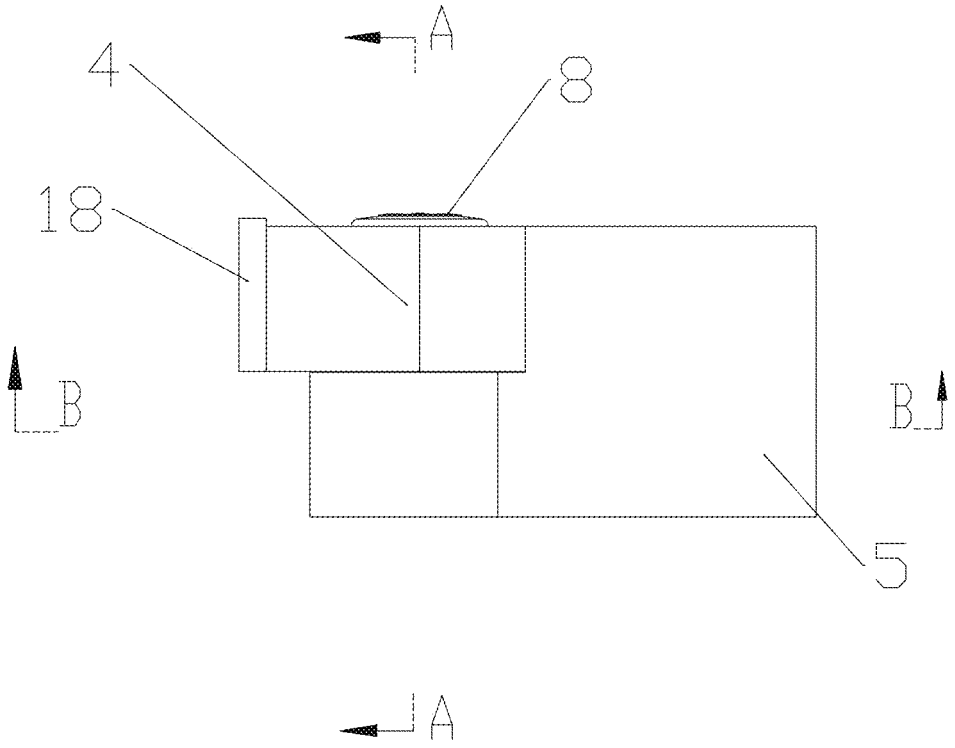
FIG. 6 is a side view of the upper wall connector of the multi-functional fence for infants according to the present invention.
Figure 7:
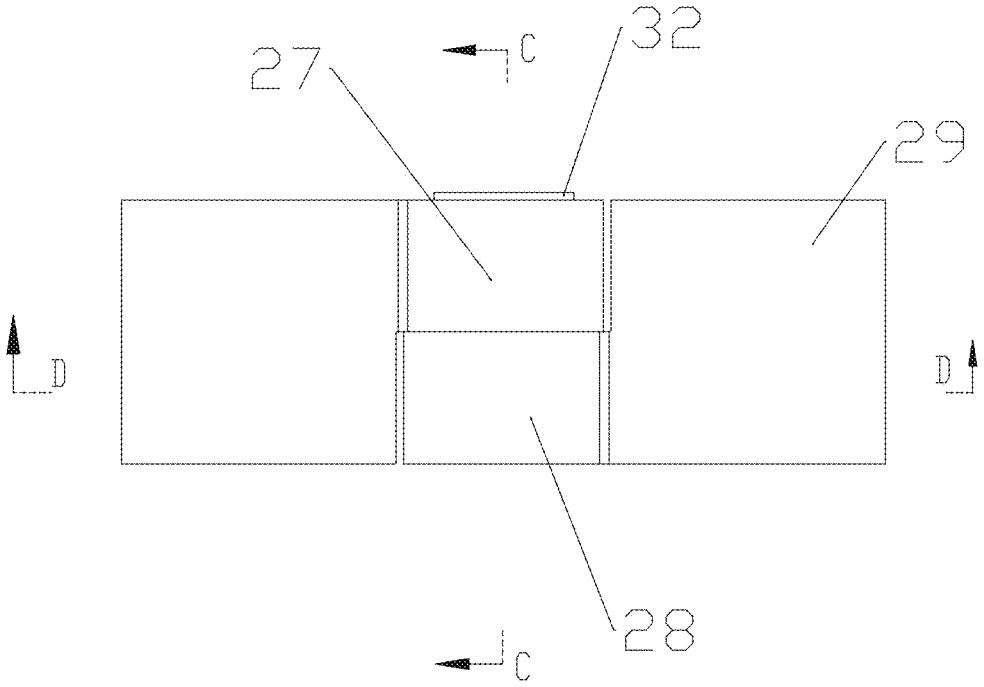
FIG. 7 is a side view of the upper fence connector of the multi-functional fence for infants according to the present invention.
Figure 8:
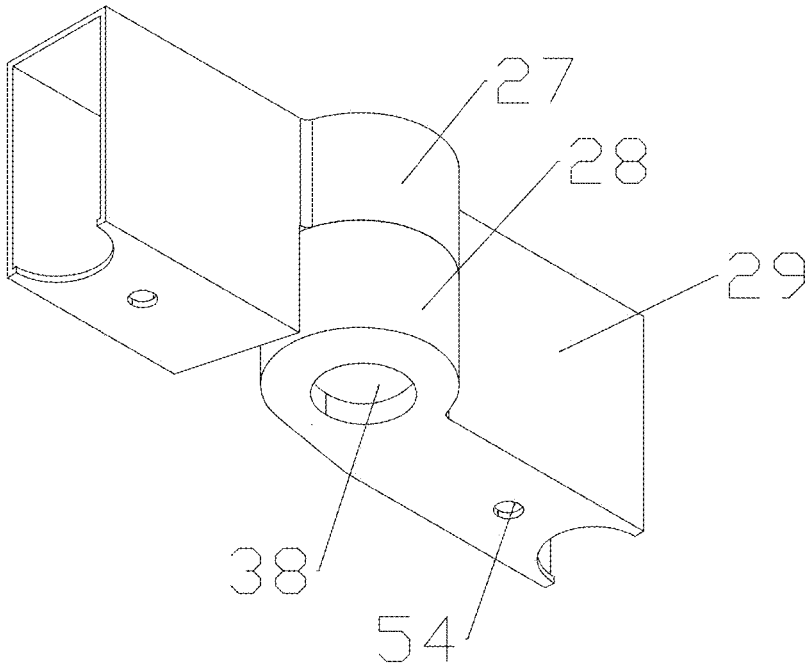
FIG. 8 is a perspective view of the upper fence connector of the multi-functional fence for infants according to the present invention.
Figure 9:
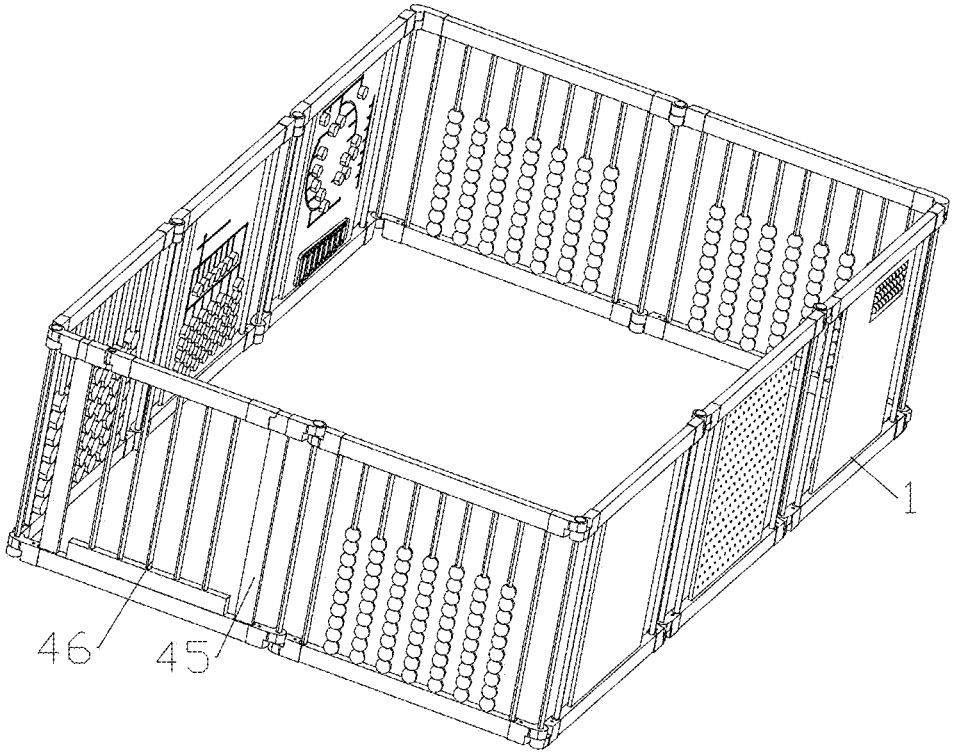
FIG. 9 is a schematic structural view of the multi-functional fence for infants according to the present invention forming an enclosed polygonal fence.
Figure 10:
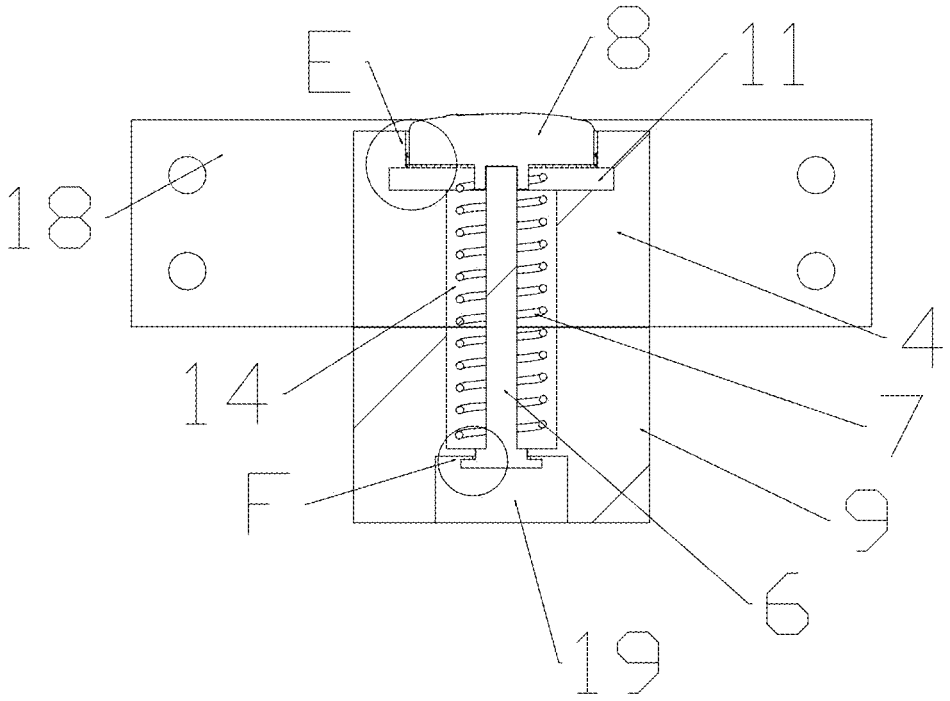
FIG. 10 is a cross-sectional view taken along line A-A in FIG. 6.
Figure 11:
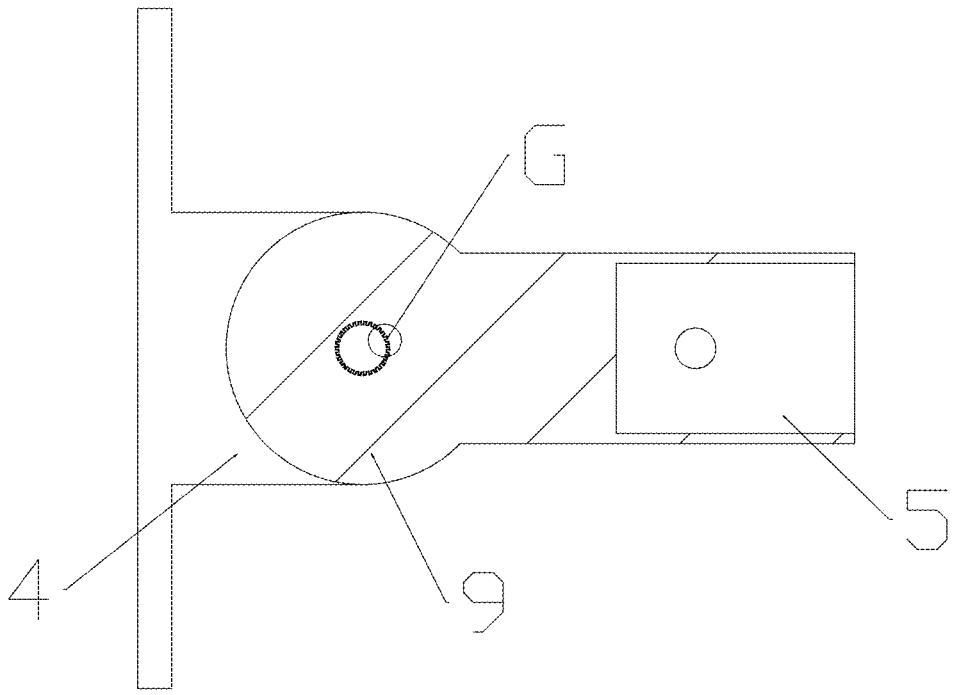
FIG. 11 is a cross-sectional view taken along line B-B in FIG. 6.
Figure 12:
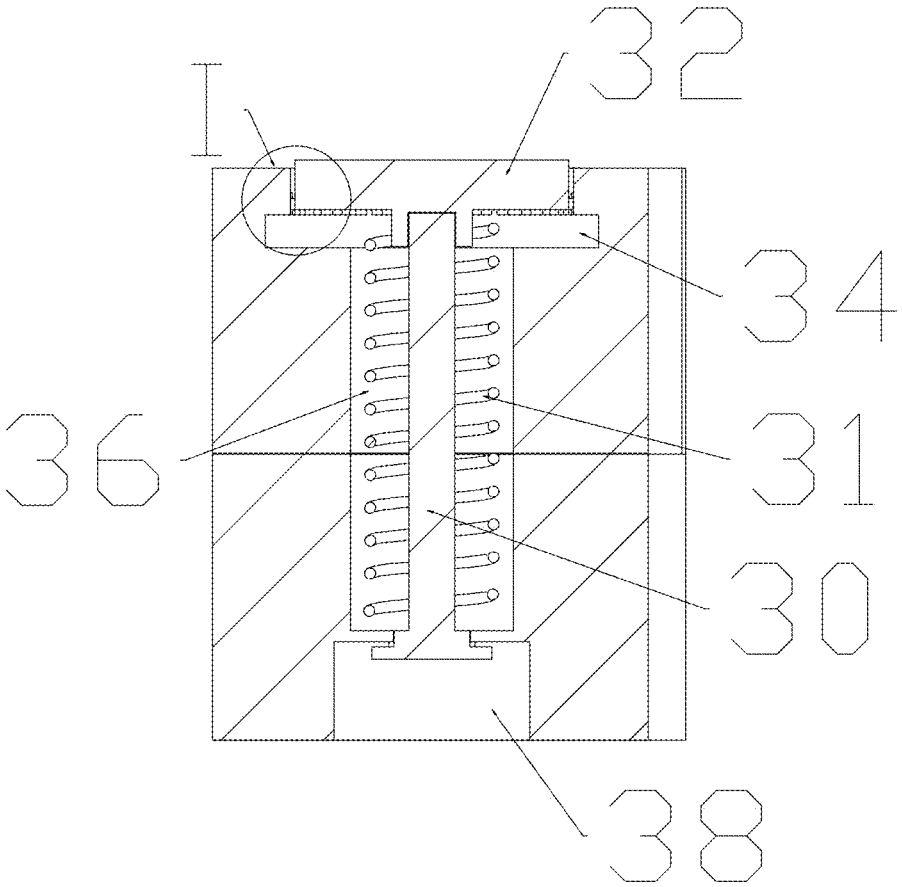
FIG. 12 is a cross-sectional view taken along line C-C in FIG. 7.
Figure 13:
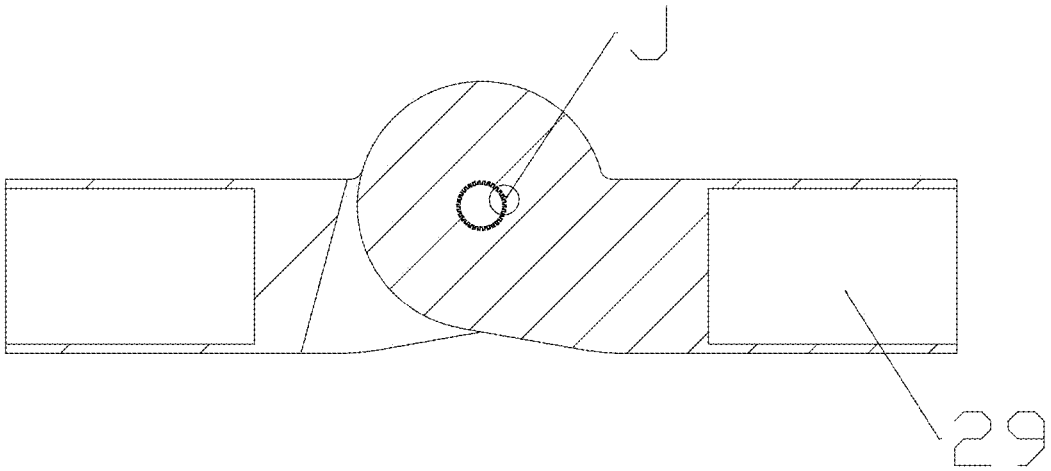
FIG. 13 is a cross-sectional view taken along line D-D in FIG. 6.
Figure 14:
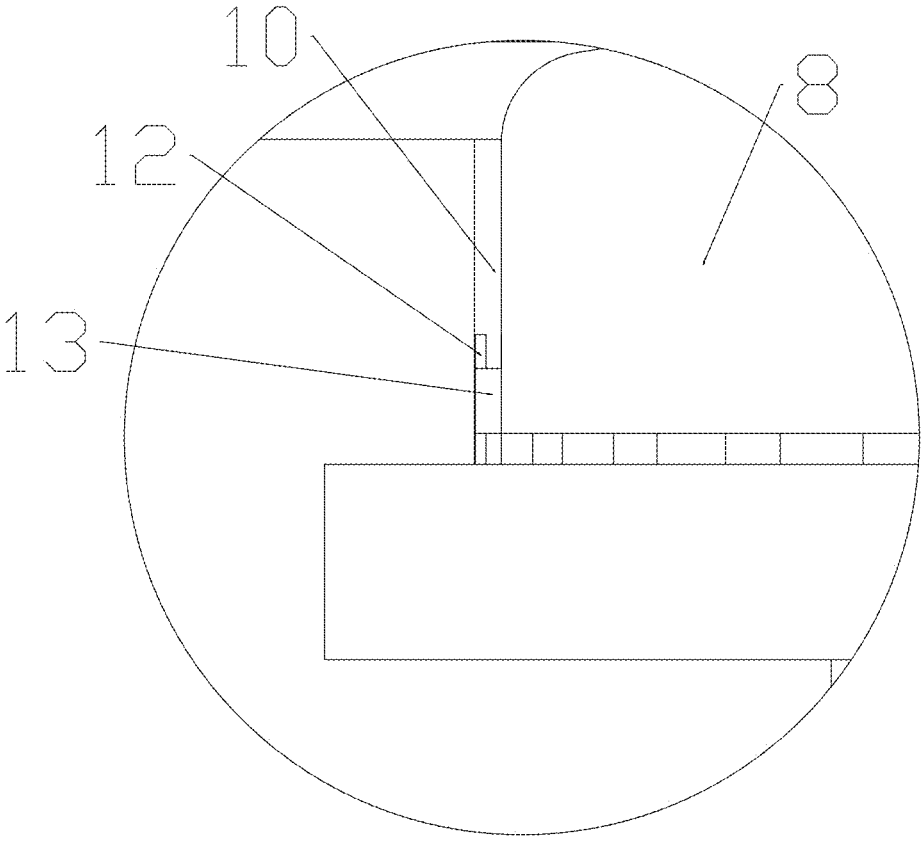
FIG. 14 is a partial enlarged view of area E in FIG. 10.
Figure 15:
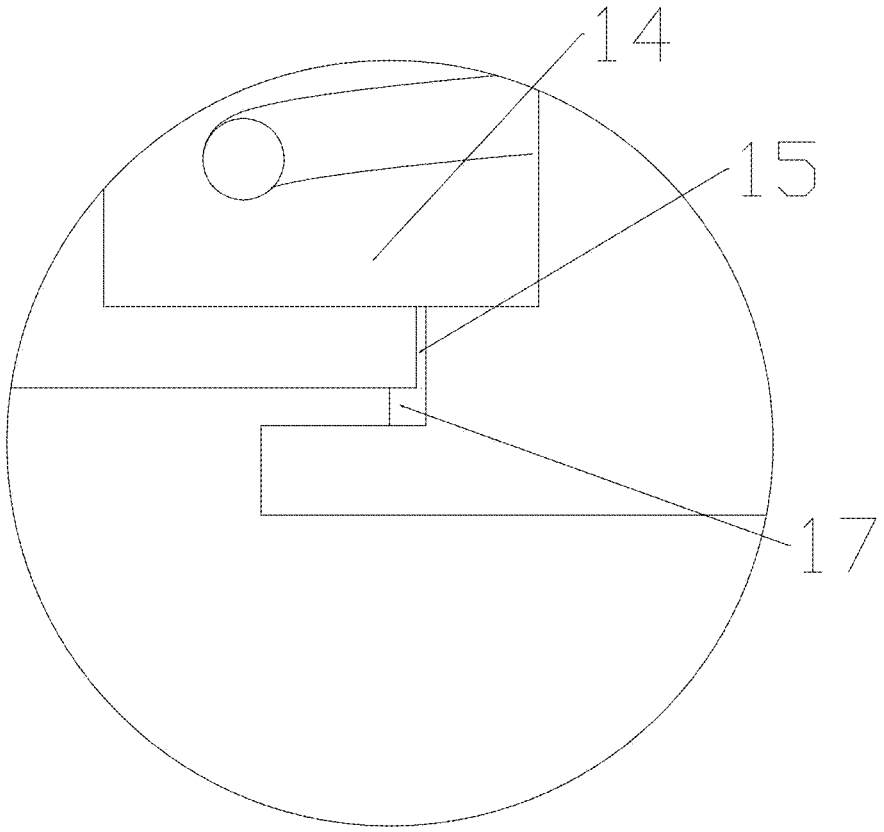
FIG. 15 is a partial enlarged view of area F in FIG. 10.
Figure 16:
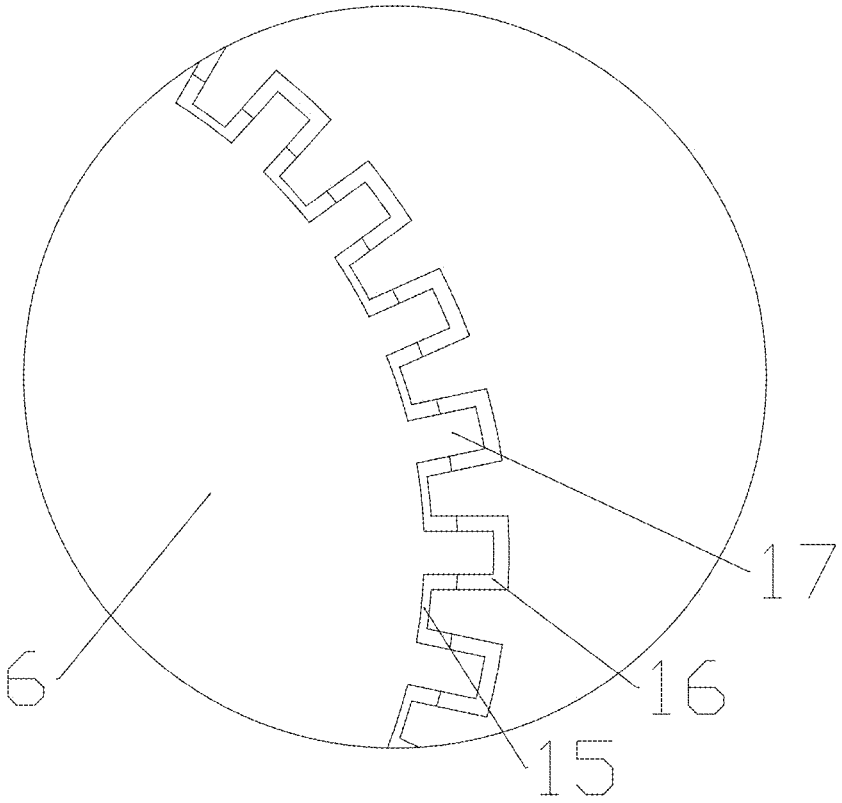
FIG. 16 is a partial enlarged view of area G in FIG. 11.
Figure 17:
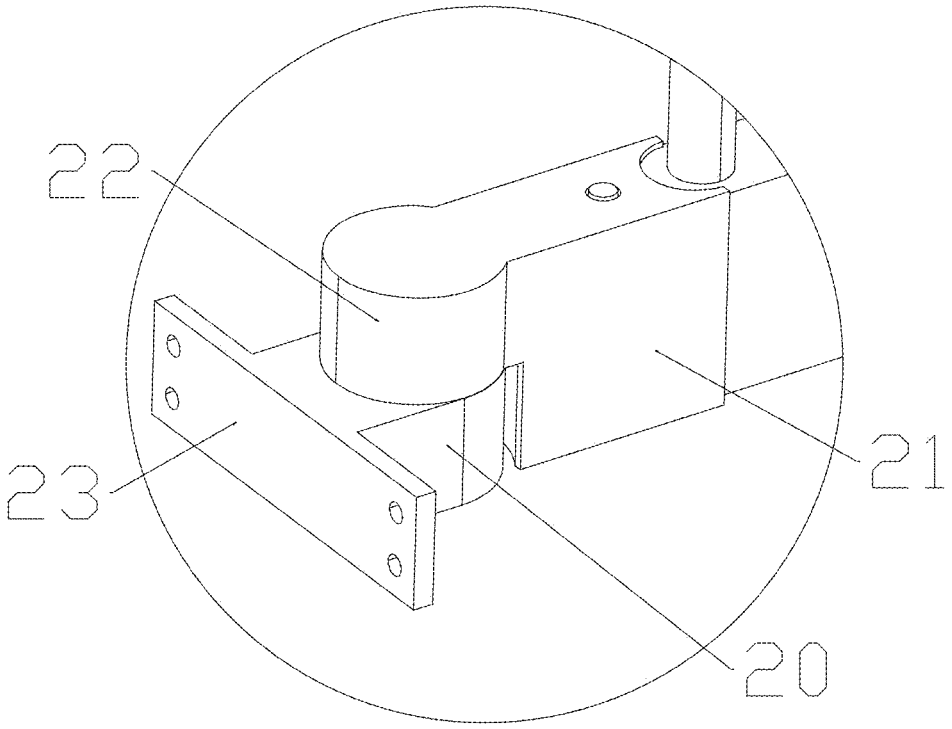
FIG. 17 is a partial enlarged view of area H in FIG. 3.
Figure 18:
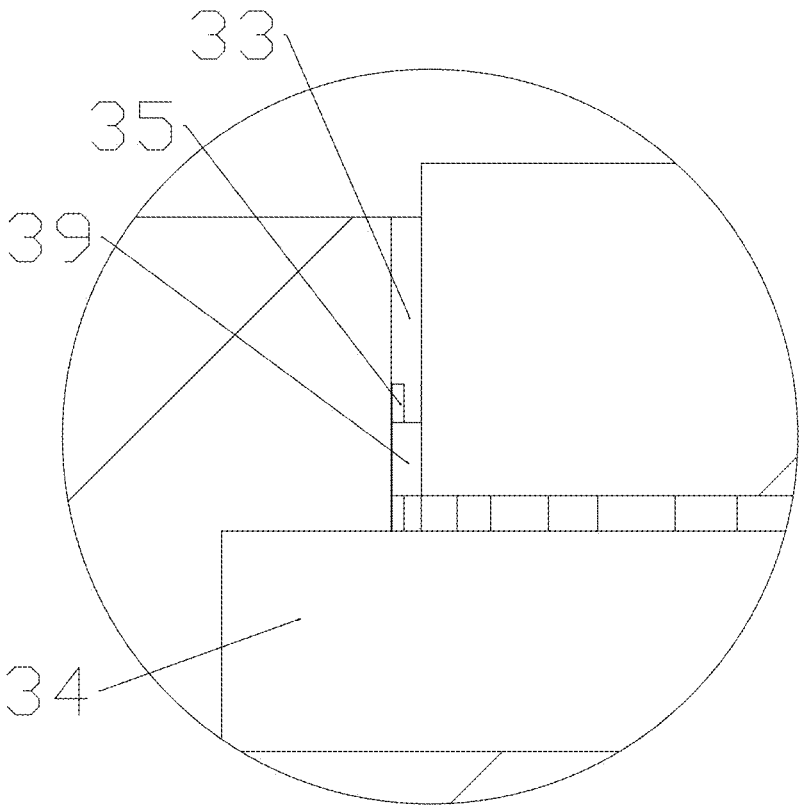
FIG. 18 is a partial enlarged view of area I in FIG. 12.
Figure 19:
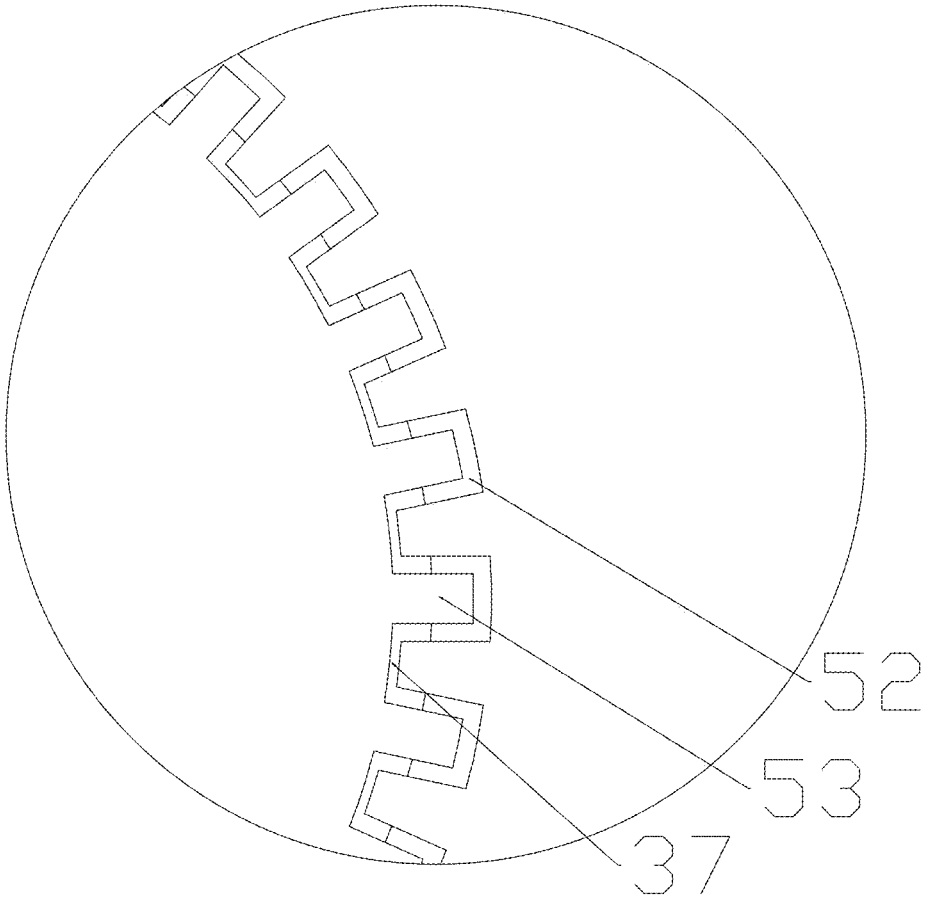
FIG. 19 is a partial enlarged view of area J in FIG. 13.
Figure 20:
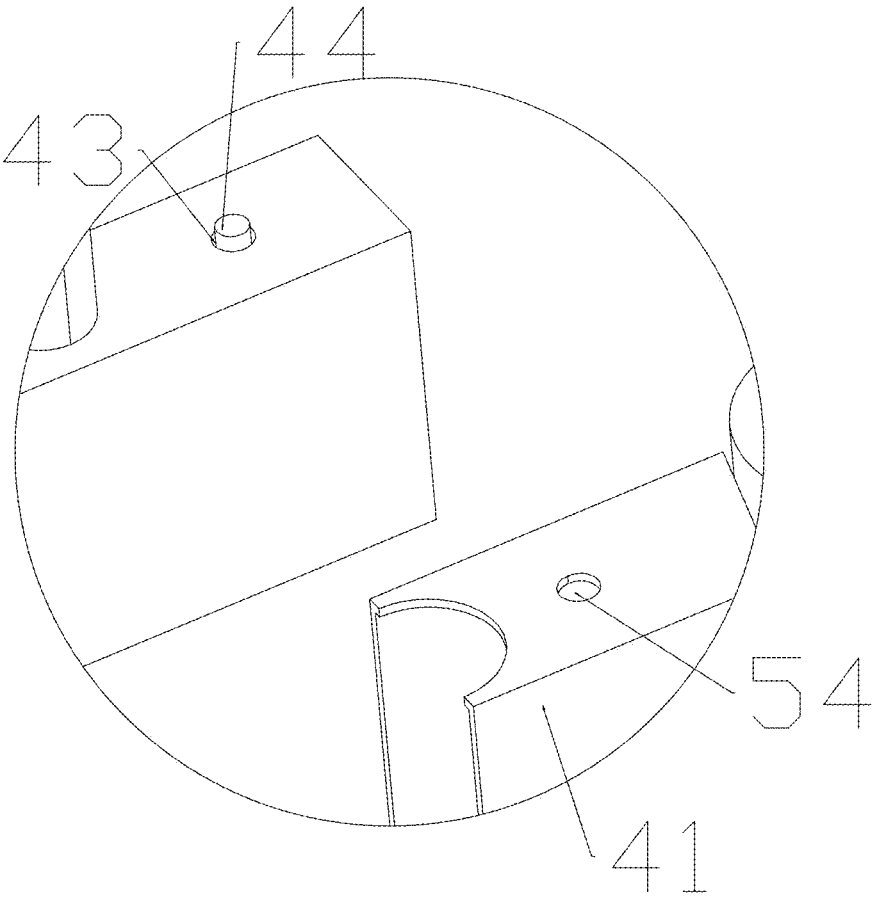
FIG. 20 is a partial enlarged view of area K in FIG. 4.
Figure 21:
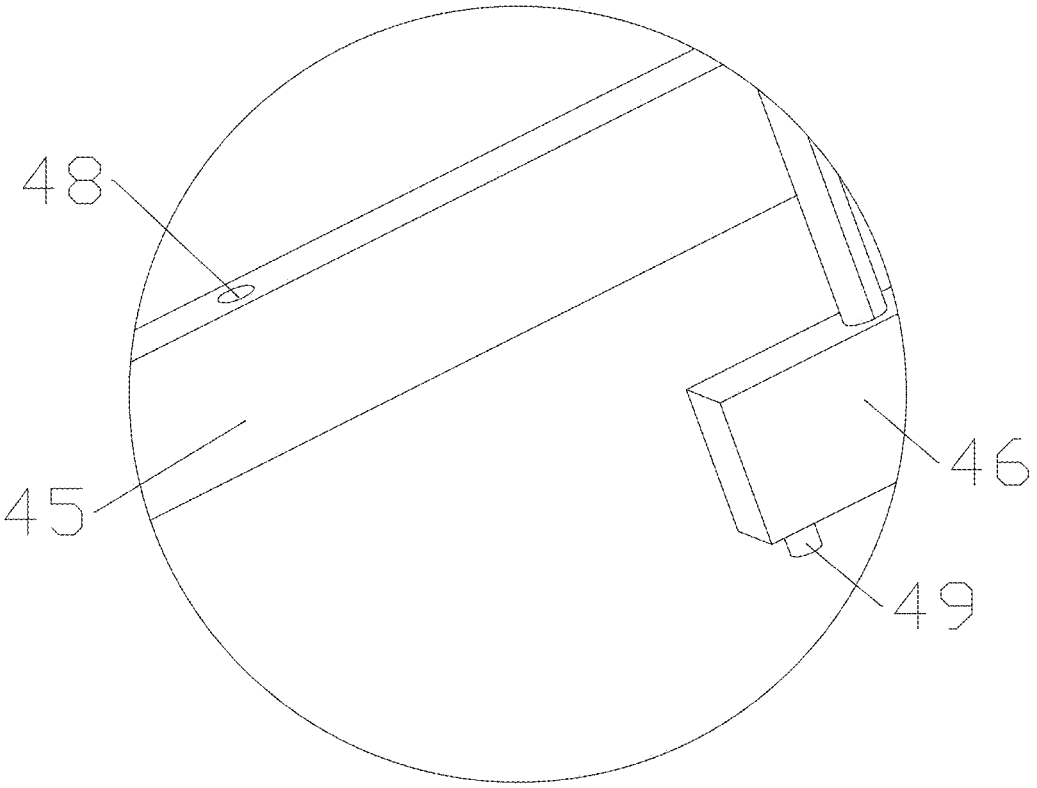
FIG. 21 is a partial enlarged view of area L in FIG. 5.

Through the combination of these components, two primary usage configurations can be achieved. In one configuration, as shown in FIGS. 1-3, adjacent fences 1 among the plurality of fences are connected via fence connectors. A gate mechanism is arranged between two of the fences 1, and both ends of the gate mechanism are respectively connected to the corresponding fences via fence connectors, forming an overall U-shaped fence with an opening at one end. The fences 1 located at both ends of the fence are provided with wall connectors at their end portions for connection and fixation to a wall, thereby securing the entire fence and achieving very high stability. In the other configuration, as shown in FIG. 9, adjacent fences 1 among the plurality of fences are connected via fence connectors. A gate mechanism is arranged between two of the fences 1, and both ends of the gate mechanism are respectively connected to the corresponding fences via fence connectors, forming an overall, fully enclosed independent polygonal fence that can be freely placed at any location indoors.

The wall connectors comprise an upper wall connector 2 and a lower wall connector 3. The upper wall connector 2 is installed at an upper end portion of a fence 1, and the lower wall connector 3 is installed at a lower end portion of a fence 1.

Implementation of the Upper Wall Connector 2:

The upper wall connector 2 comprises a first wall connector head 4, a first fence connecting sleeve 5, a first pin shaft 6, a first spring 7, and a first button 8. One end of the first fence connecting sleeve 5 is connected to the fence 1, and the other end of the first fence connecting sleeve 5 is provided with a first adapter 9. The upper end of the first wall connector head 4 is provided with a first button blind hole 10. The bottom of the first button blind hole 10 is provided with a first circular rotation chamber 11. The top of the first circular rotation chamber 11 is provided with a circle of first tooth grooves 12 arranged in a circumferential array. The first button 8 is arranged within the first button blind hole 10. The lower end of the first button 8 is provided with a circle of first limiting teeth 13 arranged in a circumferential array. Under normal conditions, the first limiting teeth 13 mesh with the first tooth grooves 12.

A center portion of the bottom of the first button blind hole 10 is provided with a first hole 14. The lower end of the first hole 14 extends into the first adapter 9. The bottom of the first hole 14 is provided with a first shaft hole 15. The first pin shaft 6 is arranged within the first shaft hole 15, and its upper end passes through the first hole 14 and is fixedly connected to the lower side of the first button 8.

The inner wall of the first hole 14 is provided with a circle of second tooth grooves 16 arranged in a circumferential array. Correspondingly, the lower end of the first pin shaft 6 is provided with a circle of second limiting teeth 17 arranged in a circumferential array. Under normal conditions, the second limiting teeth 17 mesh with the second tooth grooves 16. The first spring 7 is sleeved outside the first pin shaft 6 within the first hole 14, and the upper end of the first spring 7 abuts against the lower side of the first button 8.

When it is necessary to adjust the angle of the fence 1 relative to the wall, pressing the first button 8 downward causes the first button 8 and the first pin shaft 6 to simultaneously move downward, compressing the first spring 7. When the downward travel reaches the designated position, the first limiting teeth 13 on the first button 8 completely disengage from the first tooth grooves 12 and move into the first circular rotation chamber 11. At the same time, the second limiting teeth 17 also completely disengage from the second tooth grooves 16. At this point, the locking between the first wall connector head 4 and the first adapter 9 is released, allowing them to rotate relative to each other around the axis of the first pin shaft 6, achieving a rotation of up to 270 degrees, thereby enabling adjustment of the placement direction of the fence 1. After adjusting to the desired angle, releasing the press on the first button 8 allows the first button 8 and the first pin shaft 6 to return upward under the restoring force of the first spring 7. The first limiting teeth 13 reset and mesh with the first tooth grooves 12, and the second limiting teeth 17 reset and mesh with the second tooth grooves 16, thereby re-locking the first wall connector head 4 and the first adapter 9, completing the angle adjustment and fixation. This completes the locking between the first wall connector head 4 and the first adapter 9. The lower end of the first adapter 9 is provided with a first chamber 19 coaxial with the first shaft hole 15, providing necessary travel space for the downward movement of the first pin shaft 6.

One end portion of the first wall connector head 4 is provided with a first perforated connecting plate 18. The first perforated connecting plate 18 is connected to the wall via bolts, achieving a reliable connection at the upper end.

Implementation of the Lower Wall Connector 3:

The lower wall connector 3 comprises a second wall connector head 20, a second fence connecting sleeve 21, and a second adapter 22. The second wall connector head 20 and the second adapter 22 are rotatably connected via a bolt, allowing them to also be adjusted relative to each other within a 270-degree range in conjunction with the upper wall connector 2. One end of the second wall connector head 20 is provided with a second perforated connecting plate 23. The second perforated connecting plate 23 is connected to the wall via bolts. One end of the second adapter 22 is connected to the second fence connecting sleeve 21, and the second fence connecting sleeve 21 is connected to the fence 1.

Implementation of the Fence Connector:

The fence connector is used to connect two adjacent fences 1. The fence connector comprises an upper fence connector 24, a lower fence connector 25, and a connecting rod 26. The upper and lower ends of the connecting rod 26 are respectively and rotatably provided with the upper fence connector 24 and the lower fence connector 25. Both ends of the upper fence connector 24 are respectively connected to the upper end portions of two adjacent fences 1, and both ends of the lower fence connector 25 are respectively connected to the lower end portions of the two adjacent fences 1.

Implementation of the Upper Fence Connector 24:

The upper fence connector 24 comprises a first upper fence connector head 27, a second upper fence connector head 28, an upper fence connecting sleeve 29, a second pin shaft 30, a second spring 31, and a second button 32. Each of the first upper fence connector head 27 and the second upper fence connector head 28 is provided with an upper fence connecting sleeve 29, and one end of the upper fence connecting sleeve 29 is connected to a fence 1.

The upper end of the first upper fence connector head 27 is provided with a second button blind hole 33. A second circular rotation chamber 34 is provided at the bottom of the second button blind hole 33. The top of the second circular rotation chamber 34 is provided with a circle of third tooth grooves 35 arranged in a circumferential array. The second button 32 is arranged within the second button blind hole 33. The lower end of the second button 32 is provided with a circle of third limiting teeth 39 arranged in a circumferential array, the third limiting teeth 39 meshing with the third tooth grooves 35. A center portion of the bottom of the second button blind hole 33 is provided with a second hole 36. The lower end of the second hole 36 extends into the second upper fence connector head 28. The bottom of the second hole 36 is provided with a second shaft hole 37. The lower end of the second upper fence connector head 28 is provided with a lower hole 38 coaxial with the second shaft hole 37. The second pin shaft 30 is arranged within the second shaft hole 37, and its upper end passes through the second hole 36 to connect to the lower side of the second button 32. The inner wall of the second hole 36 is provided with a circle of fourth tooth grooves 52 arranged in a circumferential array. The lower end of the second pin shaft 30 is provided with a circle of fourth limiting teeth 53 arranged in a circumferential array, the fourth limiting teeth 53 meshing with the fourth tooth grooves 52. The second spring 31 is sleeved outside the second pin shaft 30 within the second hole 36, and the upper end of the second spring 31 abuts against the lower side of the second button 32.

When the second button 32 is pressed, the second button 32 and the second pin shaft 30 simultaneously move downward, compressing the second spring 31. When the third limiting teeth 39 on the second button 32 all move into the second circular rotation chamber 34, the fourth limiting teeth 53 also completely disengage from the fourth tooth grooves 52, thereby releasing the limitation between the first upper fence connector head 27 and the second upper fence connector head 28. This allows the first upper fence connector head 27 and the second upper fence connector head 28 to rotate relative to each other, thereby adjusting the included angle between the two adjacent fences 1, with an adjustment range of up to 270 degrees. After releasing the press on the second button 32, under the action of the second spring 31, the third limiting teeth 39 reset and mesh with the third tooth grooves 35, and the fourth limiting teeth 53 reset and mesh with the fourth tooth grooves 52, thereby completing the locking between the first upper fence connector head 27 and the second upper fence connector head 28.

The upper end of the connecting rod 26 is placed within the lower hole 38.

Implementation of the Lower Fence Connector 25:

The lower fence connector 25 comprises two lower fence connector heads 40 and a lower fence connecting sleeve 41. An end portion of each lower fence connector head 40 is provided with a lower fence connecting sleeve 41. One end of the lower fence connecting sleeve 41 is connected to a fence 1. The two lower fence connector heads 40 are rotatably connected via a bolt, thereby allowing variation in the included angle between the lower ends of adjacent fences 1.

The upper end of the upper one of the lower fence connector heads 40 is provided with an upper hole 42. The lower end of the connecting rod 26 is placed within the upper hole 42.

Connection and Fixation Method for the Fence 1, Fence Connector, Wall Connector, and Gate Mechanism:

Upper and lower ends of the fence 1, and upper and lower ends of the gate mechanism are each provided with a mounting hole 43. A press-return device 44 is arranged within the mounting hole 43. The press-return device 44 is, for example, a press-return device used in cabinet door switches in the prior art. Alternatively, an elastic ball-head latch in the prior art can also achieve the function of the press-return device 44.

Each of the second fence connecting sleeve 21, the first fence connecting sleeve 5, the upper fence connecting sleeve 29, and the lower fence connecting sleeve 41 is provided with an insertion hole 54. The insertion hole 54 cooperates with the corresponding press-return device 44.

Specifically, during installation, first press the press-return device 44 to retract its movable end into the mounting hole 43. Subsequently, insert the second fence connecting sleeve 21, the first fence connecting sleeve 5, the upper fence connecting sleeve 29, and the lower fence connecting sleeve 41 onto the corresponding end portions of the fence 1 or the gate mechanism, aligning the insertion hole 54 with the mounting hole 43. Then, insert a round rod into the insertion hole 54 to press the press-return device 44, causing the movable end of the press-return device 44 to extend and enter the insertion hole 54, achieving quick plug-in fixation. For disassembly, simply press the press-return device 44 to retract its movable end into the mounting hole 43, and then the fence connector or wall connector can be pulled out.

If the press-return device 44 employs an elastic ball-head latch, during use, when inserting the second fence connecting sleeve 21, the first fence connecting sleeve 5, the upper fence connecting sleeve 29, and the lower fence connecting sleeve 41 onto the corresponding end portions of the fence 1 or the gate mechanism, first press the movable plunger of the elastic ball-head latch to retract it into the latch. As the sleeve is inserted, the movable plunger of the elastic ball-head latch will enter the sleeve until the insertion hole 54 aligns with the mounting hole 43. At this point, the movable plunger of the elastic ball-head latch will automatically spring out and enter the insertion hole 54, limiting the position of the sleeve and completing the quick connection. For disassembly, simply press the movable plunger of the elastic ball-head latch to retract it into the latch, and then the fence connector or wall connector can be pulled out.

Implementation of the Gate Mechanism:

The gate mechanism comprises a door frame 45 and a door bar 46. Both upper ends of the door frame 45 are respectively connected to the corresponding upper fence connecting sleeves 29, and both lower ends of the door frame 45 are respectively connected to the corresponding lower fence connecting sleeves 41. The door frame 45 is provided with a door bar 46 therein. One side of the upper end of the door bar 46 and an inner side of the upper end of the door frame 45 are each provided with a rotating joint 47, and the two rotating joints 47 are rotatably connected via a pin. A side of the door bar 46 provided with the rotating joint 47 has a rotating shaft hole 48 below the rotating joint. A side of the door frame 45 provided with the rotating joint 47 has a shaft rod 49 below the rotating joint. A lower portion of the door bar 46 is rotatably mounted on the shaft rod 49 via the rotating shaft hole 48.

The upper end of the door bar 46 is provided with a dual safety gate lock 50. The dual safety gate lock 50 cooperates with the door frame 45 to achieve opening and closing of the door bar 46, preventing infants from opening it accidentally and enhancing safety.

Playful Design:

To increase the playfulness of the fence, a variety of toys 51 can be integrated or mounted on the panel(s) of one or more fences 1.

Clock+Gear Toy: A perforated board (pegboard) can be set on the fence 1, and then paired with colorful rotatable scale gear toys, adjustable hour/minute hand dial toys, etc., on the perforated board.

Colorful Bead Toy: A circular rod can be installed within the fence 1, and colorful irregular bead toys can be arranged on the rod. The bead toys can slide up and down along the circular rod. The bead toys can be designed with different patterns and shapes to increase fun.

Fifteen-Note Xylophone and Small Drum: A panel can be provided on the fence 1, and a fifteen-note xylophone and a small drum can be installed on the panel. Beautiful music can be produced by striking the xylophone and drum, cultivating infants' musical talent.

Bear Clock Calendar and Abacus Bead Toy: A panel can be provided on the fence 1. A bear pattern is drawn on the panel, and an adjustable hour/minute hand dial is set on the bear pattern. Calendar slide boards are arranged on both sides of the bear pattern on the panel, along with embedded abacus bead toys and rotatable scale gear toys.

Movable Clock Race Track Board+Percussion Xylophone: A panel can be provided on the fence 1. The panel is provided with a clock race track board (where day/night/weather can be selected based on clock time) and a percussion xylophone.

Slide Track Toy Cognitive Board: A panel can be provided on the fence 1. The panel is provided with a slide track, and abacus beads that can slide freely are placed within the track. The beads can be categorized by color or used to form letters, exercising the baby's thinking and hand-eye coordination skills.

Colorful Bead Toy: A circular rod can be installed within the fence 1, and colorful irregular bead toys can be arranged on the rod. The bead toys can slide up and down along the circular rod. The bead toys can be designed in different colors and shaped into spheres, allowing them to slide up and down the circular rod. Other toys, etc., can also be included for infants to play with.

In the description of the embodiments of the present invention, it should be noted that if terms such as "center," "upper," "lower," "left," "right," "vertical," "horizontal," "inner," "outer," etc., are used to indicate orientations or positional relationships, they are based on the orientations or positional relationships shown in the accompanying drawings or the customary orientations or positional relationships when the product of the invention is in use. These terms are used merely for the convenience of describing the present invention and simplifying the description, and do not indicate or imply that the referred device or element must have a specific orientation or be constructed and operated in a specific orientation. Therefore, such terms should not be construed as limiting the present invention. Furthermore, terms such as "first," "second," "third," etc., are used only for distinguishing descriptions and should not be understood as indicating or implying relative importance.

Additionally, if terms such as "horizontal," "vertical," "suspended," etc., are used, they do not require the components to be absolutely horizontal or suspended but may be slightly tilted. For example, "horizontal" merely indicates that its direction is more horizontal relative to "vertical" and does not mean that the structure must be completely horizontal; it may be slightly inclined.

In the description of the embodiments of the present invention, "a plurality" means at least two.

In the description of the embodiments of the present invention, it should also be noted that, unless otherwise explicitly specified or limited, terms such as "provided," "installed," "connected," and "coupled" should be interpreted broadly. For example, they may refer to fixed connections, detachable connections, or integral connections; mechanical connections or electrical connections; direct connections or indirect connections through an intermediary; or internal connections between two components. Those of ordinary skill in the art can understand the specific meanings of these terms in the context of the present invention based on specific circumstances.

The present invention and its embodiments have been described above. This description is not limiting, and the illustrations in the accompanying drawings represent only one of the embodiments of the present invention. The actual structure is not limited thereto. In summary, if those of ordinary skill in the art are inspired by the present invention and, without departing from the creative purpose of the present invention, design similar structural methods and embodiments to the technical solution without creative effort, they shall all fall within the scope of protection of the present invention.

The invention claimed is:

1. A multi-functional fence for infants, comprising a plurality of fence panels, a plurality of fence connectors, a plurality of wall connectors, and a gate mechanism; wherein adjacent ones of the plurality of fence panels are connected to each other via the fence connectors; the gate mechanism is arranged between two of the fence panels, and both ends of the gate mechanism are respectively connected to the corresponding fence panels via fence connectors; the fence panels located at both ends are provided with wall connectors at their end portions for connection and fixation to a wall, thereby securing the entire fence;

the wall connectors comprise an upper wall connector and a lower wall connector, the upper wall connector being installed at an upper end portion of a fence panel, and the lower wall connector being installed at a lower end portion of a fence panel;

the upper wall connector comprises a first wall connector head, a first fence connecting sleeve, a first pin shaft, a first spring and a first button; one end of the first fence connecting sleeve is connected to a fence panel, and another end of the first fence connecting sleeve is provided with a first adapter; an upper end of the first wall connector head is provided with a first button blind hole, a bottom of the first button blind hole is provided with a first circular rotation chamber, and a top of the first circular rotation chamber is provided with a circle of first tooth grooves in an annular array; the first button is arranged within the first button blind hole, and a lower end of the first button is provided with a circle of first limiting teeth in an annular array, the first limiting teeth meshing with the first tooth grooves; a center portion of the bottom of the first button blind hole is provided with a first hole extending downward into the first adapter, a bottom of the first hole is provided with a first shaft hole, the first pin shaft is arranged within the first shaft hole and its upper end passes through the first hole to connect to a lower side of the first button; an inner wall of the first hole is provided with a circle of second tooth grooves in an annular array, a lower end of the first pin shaft is provided with a circle of second limiting teeth in an annular array, the second limiting teeth meshing with the second tooth grooves; the first spring is sleeved outside the first pin shaft within the first hole, an upper end of the first spring abuts against the lower side of the first button; when the first button is pressed, the first button and the first pin shaft simultaneously move downward, compressing the first spring; when the first limiting teeth on the first button all move into the first circular rotation chamber, the second limiting teeth also completely disengage from the second tooth grooves, thereby releasing the limitation between the first wall connector head and the first adapter so that the first wall connector head and the first adapter can rotate relative to each other, allowing adjustment of the placement direction of the fence; releasing the press on the first button, under the action of the first spring, the first limiting teeth reset and mesh with the first tooth grooves, and the second limiting teeth reset and mesh with the second tooth grooves, thereby completing locking between the first wall connector head and the first adapter;

one end portion of the first wall connector head is provided with a first perforated connecting plate, the first perforated connecting plate being connected to a wall via a bolt.

2. The multi-functional fence for infants of claim 1, wherein a lower end of the first adapter is provided with a first chamber coaxial with the first shaft hole, for providing travel space for downward movement of the first pin shaft.

3. The multi-functional fence for infants of claim 1, wherein the lower wall connector comprises a second wall connector head, a second fence connecting sleeve, and a second adapter; the second wall connector head and the second adapter are rotatably connected via a bolt; one end of the second wall connector head is provided with a second perforated connecting plate, the second perforated connecting plate being connected to a wall via a bolt; one end of the second adapter is connected to the second fence connecting sleeve, and the second fence connecting sleeve is connected to a fence panel.

4. The multi-functional fence for infants of claim 3, wherein each fence connector comprises an upper fence connector, a lower fence connector, and a connecting rod; upper and lower ends of the connecting rod are respectively and rotatably provided with the upper fence connector and the lower fence connector; the upper fence connector is connected at both ends to upper end portions of two adjacent fence panels respectively, and the lower fence connector is connected at both ends to lower end portions of the two adjacent fence panels respectively.

5. The multi-functional fence for infants of claim 4, wherein the upper fence connector comprises a first upper fence connector head, a second upper fence connector head, a second pin shaft, a second spring and a second button; each of the first upper fence connector head and the second upper fence connector head is provided with an upper fence connecting sleeve, one end of the upper fence connecting sleeve being connected to a fence panel; an upper end of the first upper fence connector head is provided with a second button blind hole, a bottom of the second button blind hole is provided with a second circular rotation chamber, and a top of the second circular rotation chamber is provided with a circle of third tooth grooves in an annular array; the second button is arranged within the second button blind hole, and a lower end of the second button is provided with a circle of third limiting teeth in an annular array, the third limiting teeth meshing with the third tooth grooves; a center portion of the bottom of the second button blind hole is provided with a second hole extending downward into the second upper fence connector head, a bottom of the second hole is provided with a second shaft hole, a lower end of the second upper fence connector head is provided with a lower hole coaxial with the second shaft hole; the second pin shaft is arranged within the second shaft hole and its upper end passes through the second hole to connect to a lower side of the second button; an inner wall of the second hole is provided with a circle of fourth tooth grooves in an annular array, a lower end of the second pin shaft is provided with a circle of fourth limiting teeth in an annular array, the fourth limiting teeth meshing with the fourth tooth grooves; the second spring is sleeved outside the second pin shaft within the second hole, an upper end of the second spring abuts against the lower side of the second button; when the second button is pressed, the second button and the second pin shaft simultaneously move downward, compressing the second spring; when the third limiting teeth on the second button all move into the second circular rotation chamber, the fourth limiting teeth also completely disengage from the fourth tooth grooves, thereby releasing the limitation between the first upper fence connector head and the second upper fence connector head so that the first upper fence connector head and the second upper fence connector head can rotate relative to each other, allowing adjustment of the included angle between fence panels; releasing the press on the second button, under the action of the second spring, the third limiting teeth reset and mesh with the third tooth grooves, and the fourth limiting teeth reset and mesh with the fourth tooth grooves, thereby completing locking between the first upper fence connector head and the second upper fence connector head; an upper end of the connecting rod is placed within the lower hole.

6. The multi-functional fence for infants of claim 5, wherein the lower fence connector comprises two lower fence connector heads; an end portion of each the lower fence connector head is provided with a lower fence connecting sleeve, one end of the lower fence connecting sleeve being connected to a fence panel; the two lower fence connector heads are rotatably connected via a bolt;

an upper end of the upper one of the lower fence connector heads is provided with an upper hole, and a lower end of the connecting rod is placed within the upper hole.

7. The multi-functional fence for infants of claim 6, wherein upper and lower ends of fence panel, and upper and lower ends of the gate mechanism are each provided with a mounting hole, and the mounting hole is provided with a press-return device;

each of the second fence connecting sleeve, the first fence connecting sleeve, the upper fence connecting sleeve, and the lower fence connecting sleeve is provided with an insertion hole, the insertion hole cooperating with the corresponding press-return device.

8. The multi-functional fence for infants of claim 7, wherein the gate mechanism comprises a door frame and a door bar; both upper ends of the door frame are respectively connected to the corresponding upper fence connecting sleeves, and both lower ends of the door frame are respectively connected to the corresponding lower fence connecting sleeves; the door frame is provided with the door bar therein; one side of an upper end of the door bar and an inner side of an upper end of the door frame are each provided with a rotating joint, and the two rotating joints are rotatably connected via a pin; a side of the door bar provided with the rotating joint has a shaft rod below the rotating joint, a side of the door frame provided with the rotating joint has a rotating shaft hole below the rotating joint, and a lower portion of the door bar is rotatably mounted in the rotating shaft hole via the shaft rod;

an upper end of the door bar is provided with a dual safety gate lock, the dual safety gate lock cooperating with the door frame to achieve opening and closing of the door bar.

9. The multi-functional fence for infants of claim 1, wherein the fence is provided with a plurality of toys.

* * * * *